US009984614B2

(12) United States Patent
Hwang

(10) Patent No.: US 9,984,614 B2
(45) Date of Patent: May 29, 2018

(54) ORGANIC LIGHT EMITTING DISPLAY DEVICE AND METHOD OF DRIVING THE SAME

(71) Applicant: SAMSUNG DISPLAY CO., LTD., Yongin-si, Gyeonggi-do (KR)

(72) Inventor: Jae Wan Hwang, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 34 days.

(21) Appl. No.: 15/164,091

(22) Filed: May 25, 2016

(65) Prior Publication Data

US 2017/0092189 A1 Mar. 30, 2017

(30) Foreign Application Priority Data

Sep. 25, 2015 (KR) ..... 10-2015-0136233

(51) Int. Cl.

| | |
|---|---|
| ***G09G 3/32*** | (2016.01) |
| ***G09G 5/06*** | (2006.01) |
| ***G09G 3/3208*** | (2016.01) |
| ***G09G 3/20*** | (2006.01) |

(52) U.S. Cl.

CPC ..... *G09G 3/3208* (2013.01); *G09G 3/2003* (2013.01); *G09G 2320/0673* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,099,033 | B2 | 8/2015 | Son et al. | |
| 9,761,169 | B2 * | 9/2017 | Park | G09G 3/2081 |
| 9,870,733 | B2 * | 1/2018 | Chun | G09G 3/3225 |
| 2010/0309099 | A1 | 12/2010 | Kim | |
| 2010/0310094 | A1 * | 12/2010 | Lee | G09G 3/3233 381/107 |
| 2015/0062187 | A1 | 3/2015 | Park | |
| 2015/0091950 | A1 * | 4/2015 | Park | G09G 3/3291 345/690 |
| 2015/0356899 | A1 * | 12/2015 | Yamanaka | G09G 3/14 345/690 |
| 2016/0189619 | A1 * | 6/2016 | Park | G09G 3/3258 345/690 |
| 2016/0314761 | A1 * | 10/2016 | Kim | G09G 5/10 |

FOREIGN PATENT DOCUMENTS

| | | |
|---|---|---|
| KR | 10-0840319 B1 | 6/2008 |
| KR | 10-1065320 B1 | 9/2011 |
| KR | 10-2015-0026374 A | 3/2015 |

* cited by examiner

*Primary Examiner* — Wesner Sajous
(74) *Attorney, Agent, or Firm* — Lee & Morse, P.C.

(57) ABSTRACT

An organic light emitting display device includes a timing controller, data driver, and a plurality of pixels. The timing controller outputs gamma voltages corresponding to image data. The data driver generates data signals based on the gamma voltages. The pixels emit light with brightness corresponding to the data signals. The timing controller includes an on-pixel ratio (OPR) operator to calculate an OPR based on the image data and a gamma voltage supplier to select one of a plurality of gamma tables based on the OPR and to output gamma voltages stored in the selected one of the gamma tables.

16 Claims, 4 Drawing Sheets

ORGANIC LIGHT EMITTING DISPLAY DEVICE AND METHOD OF DRIVING THE SAME

CROSS-REFERENCE TO RELATED APPLICATION

Korean Patent Application No. 10-2015-0136233, filed on Sep. 25, 2015, and entitled, "Organic Light Emitting Display Device and Method of Driving the Same," is incorporated by reference herein in its entirety.

BACKGROUND

1. Field

One or more embodiments described herein relate to an organic light emitting display device and a method for driving an organic light emitting display device.

2. Description of the Related Art

An organic light emitting display device generates images using organic light emitting diodes (OLEDs). Each OLED emits light with a brightness that is based on the magnitude of a supplied driving current. The amount of driving current that flows through a pixel region of the display device may vary with input image data.

SUMMARY

In accordance with one or more embodiments, an organic light emitting display device includes a timing controller to output gamma voltages corresponding to image data; a data driver to generate data signals based on the gamma voltages; and a plurality of pixels to emit light with brightness corresponding to the data signals, wherein the timing controller includes: an on-pixel ratio (OPR) operator to calculate an OPR based on the image data; and a gamma voltage supplier to select one of a plurality of gamma tables based on the OPR and to output gamma voltages stored in the selected one of the gamma tables.

The gamma tables may include a first gamma table to store gamma voltages in accordance with a first gamma curve, in which a reference gamma value is applied to an entire grayscale region; and a second gamma table to store gamma voltages in accordance with a second gamma curve, in which a same gamma value as the first gamma curve is applied to a first grayscale region of less than a predetermined reference grayscale value and a slope is reduced in a second grayscale region of no less than the reference grayscale value.

The gamma voltage supplier may output gamma voltages stored in the first gamma table when an OPR of less than a predetermined reference value is input from the OPR operator. The gamma voltage supplier may output gamma voltages stored in the second gamma table when an OPR of no less than a predetermined reference value is input from the OPR operator. The gamma voltage supplier may include a ditherer to dithering at least some of the gamma voltages.

The ditherer may dither at least of the gamma voltages that belong to the second grayscale region among the gamma voltages stored in the second gamma table and is to output the dithered gamma voltages when an OPR of no less than the reference value is input from the OPR operator. The gamma tables may include a third gamma table in accordance with a third gamma curve, in which a same gamma value as the first and second gamma curves is applied to the first grayscale region, wherein a slope is reduced in the second grayscale region, and wherein a reduction width of brightness is set greater than in the second gamma curve.

The gamma voltage supplier may determine at least three ranges to which the OPR input from the OPR operator belongs in accordance with a value of the OPR, select a gamma table in which a reduction width of brightness is greater in the second grayscale region as the OPR belongs to a larger range, and outputs gamma voltages stored in the selected gamma table.

In accordance with one or more other embodiments, a method for driving an organic light emitting display device includes receiving image data; calculating an on-pixel ratio (OPR) based on the image data; selecting one of a plurality of gamma tables based on the OPR; outputting gamma voltages stored in the selected gamma table; generating data signals based on the gamma voltages; and displaying an image with brightness corresponding to the data signals.

Outputting gamma voltages may include outputting gamma voltages in accordance with a first gamma curve, in which a reference gamma value is applied to an entire grayscale region, when the OPR of less than a predetermined reference value is input.

Outputting gamma voltages stored may include outputting gamma voltages in accordance with a second gamma curve, in which a reference gamma value is applied to a first grayscale region of less than a predetermined reference grayscale value and a slope is reduced in a second grayscale region of no less than the reference grayscale, when an OPR of no less than a predetermined reference value is input. The method may include dithering at least gamma voltages in the second grayscale region for output. At least three ranges to which the OPR belongs may be determined.

Outputting gamma voltages may include outputting gamma voltages in which a reference gamma value is applied to an entire grayscale region when the OPR belongs to a first range, and outputting at least gamma voltages set to reduce brightness in comparison with the reference gamma value in a second grayscale region of no less than a predetermined reference grayscale when the OPR belongs to a second range different from the first range. The method may include setting reduction widths of brightness of the gamma voltages differently in accordance with a range of the OPR when the OPR belongs to the second range.

Outputting the gamma voltages may include outputting gamma voltages, in which a reference gamma value is applied to a first grayscale region of less than a predetermined reference grayscale, regardless of the OPR.

In accordance with one or more other embodiments, an apparatus includes a calculator to calculate an OPR based on image data; and a selector to select one of a plurality of gamma tables based on the OPR and to output gamma voltages stored in the selected one of the gamma tables, the output gamma voltages corresponding to an image to be displayed on a display device. The gamma tables may include a first table to store gamma voltages corresponding to a first gamma curve in which a reference gamma value is applied to an entire grayscale region; and a second table to store gamma voltages corresponding to a second gamma curve in which a same gamma value as the first gamma curve is applied to a first grayscale region of less than a predetermined reference grayscale value and having a slope that is reduced in a second grayscale region of no less than the reference grayscale value.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
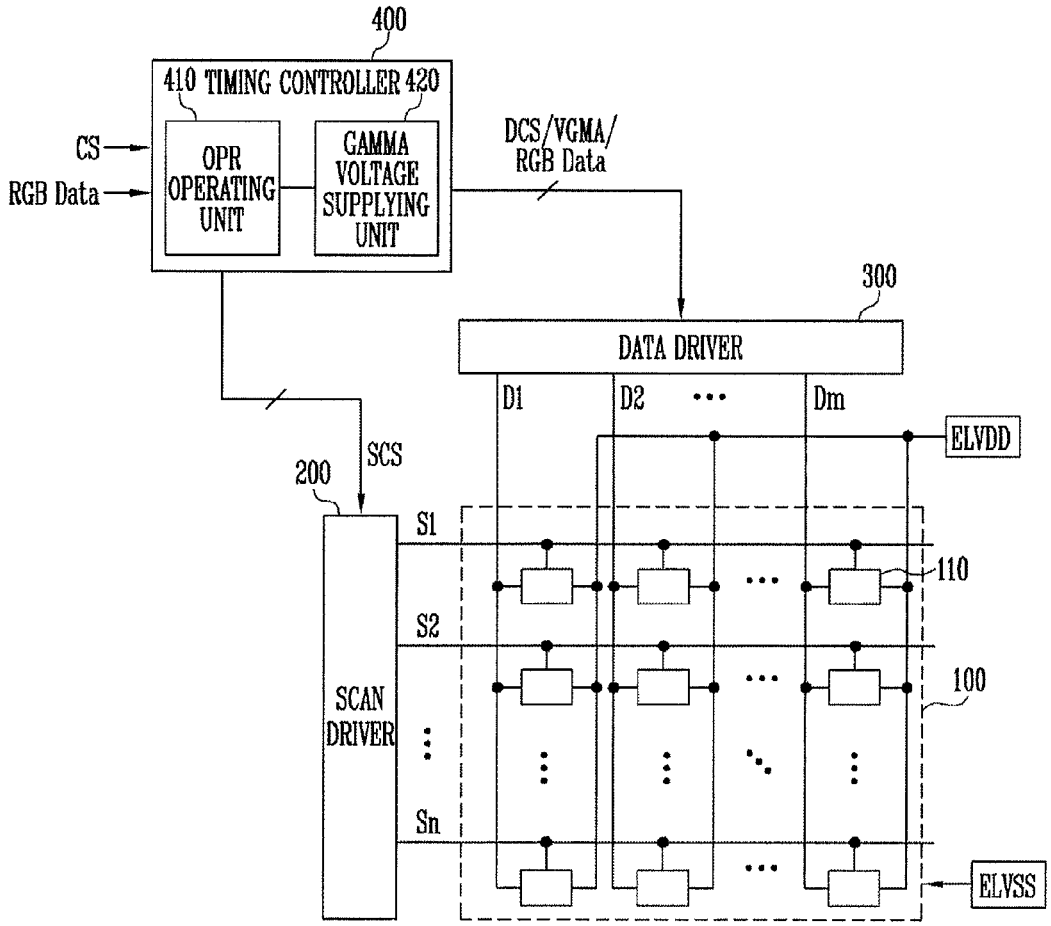
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
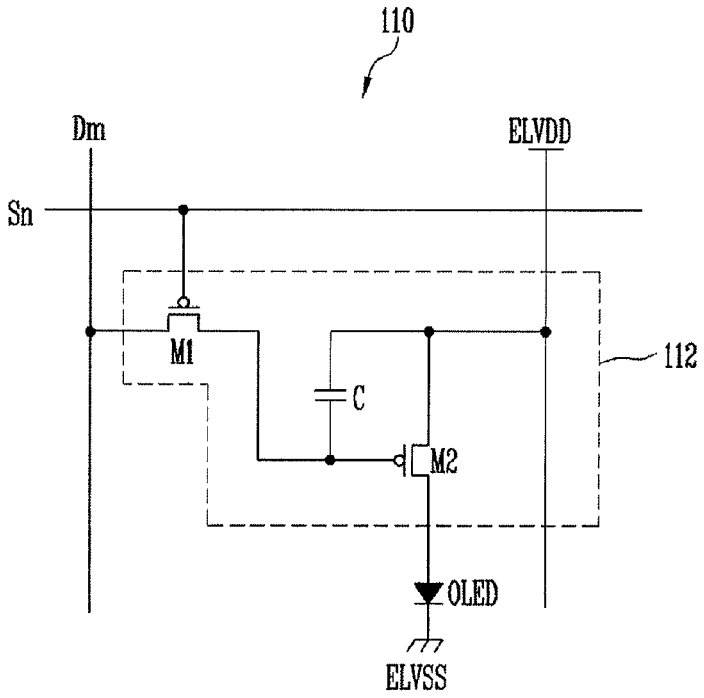
FIG. 2 illustrates an embodiment of a pixel.

FIG. 1 illustrates an embodiment of an organic light emitting display device, and FIG. 2 illustrates an embodiment of a pixel. For illustrative purposes, the pixel in FIG. 2 is connected to an nth scan line Sn and an mth data line Dm.

Referring to FIG. 1, the organic light emitting display device includes a plurality of pixels 110 arranged in a display region 100, a scan driver 200 and a data driver 300 for driving the pixels 110, and a timing controller 400 for driving the scan driver 200 and the data driver 300. The display region 100 includes scan lines S1 to Sn and data lines D1 to Dm that intersect each other, and the pixels 110 are connected to the scan lines S1 to Sn and the data lines D1 to Dm. The pixels 110 receive data signals from respective data lines D arranged in corresponding vertical lines when scan signals are supplied from scan lines S in corresponding horizontal lines. The pixels 110 emit light with brightness that corresponds to the data signals.

Referring to FIG. 2, each pixel 110 includes an organic light emitting diode OLED and a pixel circuit 112 for supplying a driving current to the OLED. A first electrode (for example, an anode electrode) of the OLED is connected to the pixel circuit 112 and a second electrode (for example, a cathode electrode) of the OLED is connected to a second power source ELVSS. The second power source ELVSS may be set as a low potential pixel power source. The OLED emits light with brightness corresponding to the driving current supplied from the pixel circuit 112.

The pixel circuit 112 receives a data signal from the data line Dm when a scan signal is supplied from the scan line Sn. The pixel circuit 112 controls when driving current is supplied to the OLED and controls the amount of driving current based on the data signal.

The pixel circuit 112 includes a first transistor M1, a second transistor M2, and a storage capacitor C. The first transistor (switching transistor) M1 is connected between the data line Dm and a first electrode of the storage capacitor C and a gate electrode of the first transistor M1 is connected to the scan line Sn. The first transistor M1 is turned on when the scan signal is supplied from the scan line Sn and transmits the data signal from the data line Dm to the storage capacitor C. Therefore, the voltage corresponding to the data signal is charged in the storage capacitor C.

The second transistor (driving transistor) M2 is connected between a first power source ELVDD and the OLED and a gate electrode of the second transistor M2 is connected to the first electrode of the storage capacitor C. The second transistor M2 controls the driving current that flows from the first power source ELVDD to the second power source ELVSS, via the OLED, based on the voltage supplied to the gate electrode of the second transistor M2, that is, the voltage corresponding to the data signal. The first power source ELVDD may be a pixel power source having a higher electric potential than second power source ELVSS.

The OLED emits light with a brightness corresponding to the driving current. When a data signal corresponding to a black grayscale is supplied, the second transistor M2 does not supply the driving current to the OLED. As a result, the OLED does not emit light.

The storage capacitor C stores the voltage corresponding to the data signal supplied via the first transistor M1 and maintains the stored voltage, for example, until a data signal of a next frame is supplied.

The pixel 110 receives a data signal every frame period and emits light with brightness corresponding to the received data signal to display a grayscale.

The OLED may deteriorate over time. For example, as an accumulated emission amount (e.g., accumulated emission brightness and accumulated emission time) of the OLED increases (that is, as the amount of the driving current supplied to the OLED increases), the OLED may deteriorate severely.

In accordance with one embodiment, the driving current that flows through the OLED is selectively reduced in a predetermined (e.g., high) grayscale region of no less than a predetermined reference grayscale value. This may be performed based on an on-pixel ratio (OPR) calculated based on input image data RGB Data. As a result, deterioration of the OLED may be reduced or minimized.

Referring again to FIG. 1, the scan driver 200 receives a scan control signal SCS from the timing controller 400. The scan driver 200 generates the scan signals based on the scan control signal SCS and supplies the scan signals to the scan lines S1 to Sn. When the scan signals are supplied to the scan lines S1 to Sn, the pixels 110 are selected in units of horizontal lines.

The data driver 300 receives a data control signal DCS, gamma voltages VGMA, and image data RGB Data from the timing controller 400. The data driver 300 generates data signals using the data control signal DCS, the gamma voltages VGMA, and the image data RGB Data. The data signals are supplied to the pixels 110 through the data lines D1 to Dm. The pixels 110 emit light with a brightness corresponding to the data signals.

The timing controller 400 generates the scan control signal SCS and the data control signal DCS based on a control signal CS (e.g., supplied from an external source) and supplies the scan control signal SCS and data control signal DCS to the scan driver 200 and the data driver 300, respectively. The control signal CS supplied to the timing controller 400 may include, for example, vertical/horizontal synchronizing signals, a clock signal, and/or an enable signal.

The timing controller 400 re-aligns the image data RGB Data (e.g., input from an external source) and supplies the re-aligned image data RGB Data to the data driver 300. In addition, the timing controller 400 supplies the gamma voltages VGMA of previously stored gamma tables to the data driver 300.

The gamma voltages VGMA used for generating the data signals serve as reference voltages of data signals for specific grayscale values. For example, voltages of data signals in corresponding grayscale values are determined in accordance with gamma voltages VGMA for respective grayscale values. Therefore, the gamma voltages VGMA serve as a basis for determining the driving currents that flow through the pixels 110 and the brightness in accordance with the driving currents.

The gamma voltages VGMA for respective grayscale values may be stored, for example, based on a gamma 2.2 curve in which a gamma value is set as 2.2. The stored gamma voltages VGMA may be supplied to the data driver 300.

For convenience sake, in FIG. 1, the gamma voltages VGMA and the image data RGB Data are separate from each other. In another embodiment, the gamma voltages VGMA may be applied to the input image data RGB Data to convert the input image data RGB Data in the timing controller 400. The converted image data RGB Data to which the gamma voltages VGMA are applied may then be supplied to the data driver 300.

In accordance with one embodiment, the timing controller 400, for outputting the gamma voltages VGMA corresponding to the input image data RGB Data, calculates the OPR based on the input image data RGB Data and outputs the gamma voltages VGMA for selectively reducing the brightness of the pixels 110 in accordance with the calculated OPR. The OPR represents the driving amount of input image data RGB Data for a maximum (or other predetermined) driving amount. In one embodiment, the OPR may be based on an average emission ratio of light-emitting pixels.

The timing controller 400 according to the embodiment of the present invention includes an OPR operating unit 410 and a gamma voltage supplying unit 420. According to the current embodiment, both the OPR operating unit 410 and the gamma voltage supplying unit 420 are formed in the timing controller 400. However, the present invention is not limited thereto. That is, the OPR operating unit 410 and/or the gamma voltage supplying unit 420 may be formed outside the timing controller 400 to be separate from the timing controller 400.

The OPR operating unit 410 receives the input image data RGB Data and calculates the OPR using the input image data RGB Data. For example, the OPR operating unit 410 calculates the OPR by adding the input image data RGB Data for all the light-emitting pixels 110 of a corresponding frame and dividing the sum by resolution. According to an embodiment, the input image data RGB Data and the OPR may be digital values.

According to an embodiment, the OPR operating unit 410 separately calculates OPRs for first color (for example, red) sub-pixels, second color (for example, green) sub-pixels, and third color (for example, blue) sub-pixels. The OPR operating unit 410 may supply the calculated OPRs to the gamma voltage supplying unit 420, or the OPR operating unit 410 may add input image data items on sub-pixels of all colors to calculate an integrated OPR. The calculated integrated OPR may then be supplied to the gamma voltage supplying unit 420.

The gamma voltage supplying unit 420 may include a plurality of gamma tables which have been previously stored therein. The gamma voltage supplying unit 420 selects one of the gamma tables based on the OPR received from the OPR operating unit 410 and outputs the gamma voltages VGMA stored in the selected gamma table.

Figure 3:
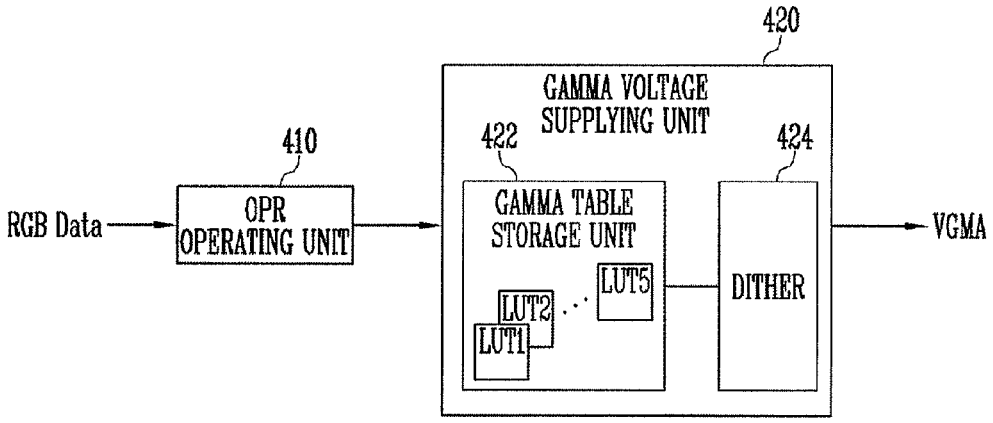
FIG. 3 illustrates an embodiment of a gamma voltage supplying unit.
Figure 4:
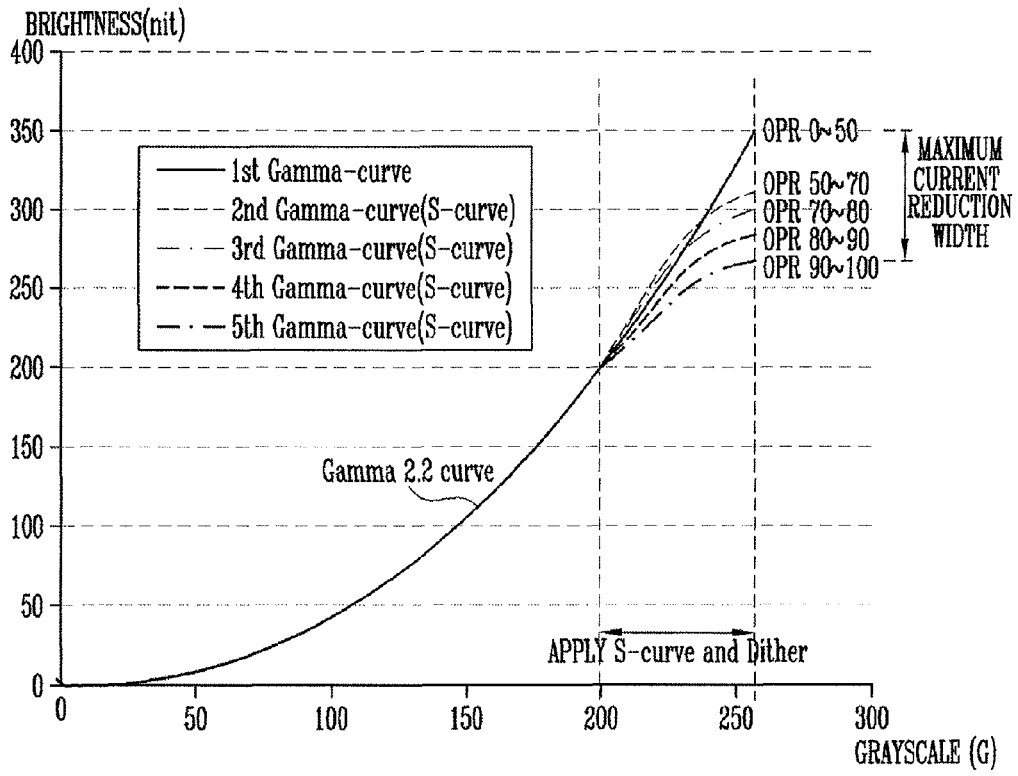
FIG. 4 illustrates an example of gamma curves.

FIG. 3 illustrates an embodiment of the gamma voltage supplying unit 420 in FIG. 1. FIG. 4 illustrates an example of gamma curves that may be respectively applied to the gamma tables of FIG. 3 in accordance with one embodiment.

Referring to FIG. 3, the gamma voltage supplying unit 420 includes a gamma table storage unit 422 for storing a plurality of gamma tables LUT1 to LUT5 and a dither 424. The gamma table storage unit 422 may include at least two gamma tables, for example, the first and second gamma tables LUT1 and LUT2. In one embodiment, the gamma table storage unit 422 may include one or more gamma tables. For example, the gamma table storage unit 422 may include the first to fifth gamma tables LUT1 to LUT5.

The first gamma table LUT1 stores gamma voltages in accordance with a first gamma curve in which a reference gamma value (for example, gamma value of 2.2) is applied to an entire grayscale region. For example, the first gamma table LUT1 may store gamma voltages VGMA by grayscale values in accordance with the first gamma curve set as the gamma 2.2 curve in FIG. 4*d*.

In the second to fifth gamma tables LUT2 to LUT5, the same gamma value (for example, the gamma value of 2.2) as the first gamma curve may be stored in a low grayscale region of less than the predetermined reference grayscale value. The gamma voltages VGMA by grayscales in accordance with the second to fifth gamma curves, in which slopes of brightness curves (gamma curves) in accordance with grayscales are gradually reduced unlike in the first gamma curve, may be stored in a high grayscale region of no less than the reference grayscale value.

According to an embodiment, the predetermined reference grayscale may be set as a grayscale larger than an intermediate grayscale. For example, when 256 grayscales of grayscales 0 to 255 exist, the reference grayscale in which the respective gamma curves are separate from each other may be set as the grayscale value of 200.

For example, among the gamma voltages VGMA stored in the first to fifth gamma tables LUT1 to LUT5, gamma voltages VGMA corresponding to grayscale values less than the predetermined reference grayscale value are set to be the same, and gamma voltages VGMA corresponding to grayscale values of no less than the reference grayscale may be set to be different from each other in accordance with the respective gamma tables LUT1 to LUT5.

Therefore, the first gamma curve corresponding to the gamma voltages VGMA stored in the first gamma table LUT1, the second gamma curve corresponding to the gamma voltages VGMA stored in the second gamma table LUT2, the third gamma curve corresponding to the gamma voltages VGMA stored in the third gamma table LUT3, the fourth gamma curve corresponding to the gamma voltages VGMA stored in the fourth gamma table LUT4, and the fifth gamma curve corresponding to the gamma voltages VGMA stored in the fifth gamma table LUT5 may overlap and coincide with each other in the low grayscale region of less than the reference grayscale value and may be separate from each other with different brightness curves in the high grayscale region based on the reference grayscale value.

For example, the remaining gamma curves (e.g., the second to fifth gamma curves excluding the first gamma curve) in which the reference gamma value is applied to the entire grayscale region are S-curves. As a result, the slopes of the brightness curves (the gamma curves) in accordance with the grayscale values are gradually reduced in the high grayscale region of no less than the reference grayscale value.

The brightness of the highest grayscale value in accordance with the second to fifth gamma curves may be set to have a lower value than brightness of the highest grayscale value in accordance with the first gamma curve. For example, the brightness of the highest grayscale may be reduced from the second gamma curve toward the fifth gamma curve. Therefore, a reduction width of a maximum current is the largest in the fifth gamma curves, e.g., the reduction width of brightness may be set to be larger from the second gamma curve toward the fifth gamma curve.

In this case, in one embodiment, the gamma voltage supplying unit 420 selects one of the first to fifth gamma tables LUT1 to LUT5 in accordance with a value of the OPR from the OPR operating unit 410 and outputs the gamma voltages VGMA of the selected gamma table. For example, the gamma voltage supplying unit 420 determines the range to which the value of the OPR belongs among a number of ranges. The number of ranges may corresponds to the number of gamma tables stored in the gamma table storage unit 422. The gamma voltage supplying unit 420 may select a gamma table in response to the value.

In one embodiment, the gamma voltage supplying unit 420 may select the first gamma table LUT1 when the value of the OPR is no less than 0 and less than 50, the second gamma table LUT2 when the value of the OPR is no less than 50 and less than 70, the third gamma table LUT3 when the value of the OPR is no less than 70 and less than 80, the fourth gamma table LUT4 when the value of the OPR is no less than 80 and less than 90, and the fifth gamma table LUT5 when the value of the OPR is no less than 90 and less than 100.

According to an embodiment, the second gamma curve may be set so that the reduction width of the maximum current is a predetermined percentage (e.g., about 5%) in comparison with the first gamma curve. The third gamma curve, the fourth gamma curve, and the fifth gamma curve may be set so that the reduction widths of the maximum current correspond to respective predetermined percentages (e.g., about 10%, 20%, and 30%) in comparison with the first gamma curve.

Thus, the gamma voltage supplying unit 420 selects one of the gamma tables, for example, the first to fifth gamma tables LUT1 to LUT5, based on a previously set reference value of the OPR. The gamma voltage supplying unit 420 outputs the gamma voltages VGMA stored in the first gamma table LUT1 (in which the reference gamma value is applied) to the entire grayscale region when the OPR of less than the reference value is input from the OPR operating unit 410.

The gamma voltage supplying unit 420 selects one of the S-curved gamma tables (e.g., the second to fifth gamma tables LUT2 to LUT5) having a slope which is gradually reduced in the high grayscale region of no less than the predetermined reference grayscale value in accordance with the OPR based on a predetermined reference when the OPR of no less than the reference value is input from the OPR operating unit 410. The gamma voltages VGMA stored in the selected gamma table are then output.

For example, the gamma voltage supplying unit 420 differentially selects a gamma table in which the reduction width of the brightness is larger in the high grayscale region, as the OPR input from the OPR operating unit 410 belongs to a larger range, and may output the gamma voltages VGMA stored in the selected gamma table.

Therefore, current consumption may be more remarkably reduced in comparison with the case where the brightness in the high grayscale region is limited regardless of the OPR. Therefore, according to one embodiment, deterioration of the pixels 110 may be reduced or minimized while maximizing effect of reducing power consumption.

According to the current embodiment, it is determined the range to which the value of the OPR of no less than the reference value belongs among the plurality of ranges. The plurality of S-curved gamma curves may be selected in accordance with the OPR.

For example, the gamma voltage supplying unit 420 may have only two gamma tables (first and second gamma tables LUT1 and LUT2). The gamma voltage supplying unit 420 may select the first gamma table LUT1 for an OPR of less than the reference value and the remaining gamma table (LUT2) for an OPR of no less than the reference value and may output the gamma voltages VGMA.

In one embodiment, the reference for the ranges may be changed so that the first gamma table LUT1 may be selected for an OPR of no more than the reference value, e.g., for values less than the reference value. One of the second to fifth gamma tables LUT2 to LUT5 may be selected only for an OPR larger than the reference value.

According to an embodiment, the gamma voltage supplying unit 420 may output the gamma voltages VGMA stored in one of the second to fifth gamma tables LUT2 to LUT5 after dithering at least the gamma voltages VGMA that belong to the high grayscale region of no less than the reference grayscale, when an OPR of no less than the reference value is input from the OPR operating unit 410.

For this purpose, the gamma voltage supplying unit 420 may further include dither 424 for dithering at least some gamma voltages, for example, at least the gamma voltages VGMA in the high grayscale region of no less than the reference grayscale. For example, the gamma voltage supplying unit 420 may output the gamma voltages VGMA stored in the first gamma table LUT1 without performing dithering and may output the gamma voltages VGMA stored in one of the second to fifth gamma tables LUT2 to LUT5 after dithering at least the gamma voltages VGMA in the high grayscale region of no less than the reference grayscale.

When the dithering is performed as described above, it is possible to reduce or minimize grayscale banding that may otherwise occur, for example, when the gamma voltages VGMA in accordance with the S-curved second to fifth gamma curves are applied to the high grayscale region. Therefore, according to one embodiment, it is possible to prevent picture quality from deteriorating due to the grayscale banding when brightness is limited. Therefore, it is possible to extend the reduction width of the maximum current in comparison with a case where dithering is not performed.

Figure 5:
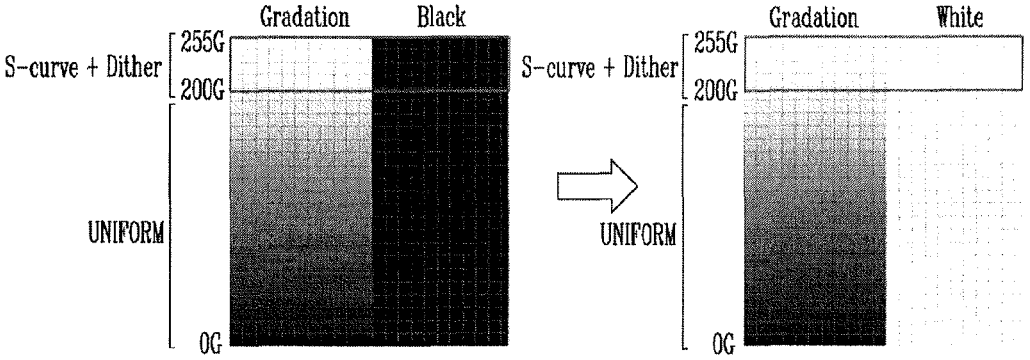
FIG. 5 illustrates an example of a screen change according to one embodiment.

FIG. 5 illustrates an example of a result of observing a change in screen in accordance with one embodiment. Referring to FIG. 5, when a transition is made from a left screen in which the OPR is low to a right screen in which the OPR is high, it may be experimentally noted that flickering is reduced or minimized as a result of outputting the gamma voltages VGMA.

More specifically, when brightness is limited by applying an S-curved gamma curve (one of the second to fifth gamma curves) only to a partial high grayscale section (for example, a section of no less than a grayscale value of 200) according to one embodiment, instead of changing the gamma value in the entire grayscale region, it is possible to reduce or minimize flicker that otherwise may be generated when display characteristics rapidly changes.

In addition, according to one embodiment, when the gamma voltages VGMA in the high grayscale section in which the brightness is limited are dithered and output, it is possible to reduce or minimize the grayscale banding in the corresponding section and to prevent the picture quality from deteriorating.

As described above, according to at least one embodiment, the gamma voltages VGMA are output so that, based on the predetermined reference grayscale (for example, the grayscale value of 200), the reference gamma value (for example, the gamma value of 2.2) is applied to the low grayscale region and brightness is selectively limited in accordance with the OPR only in the high grayscale region. Therefore, it is possible to reduce or minimize deterioration in picture quality caused by flicker and to reduce current consumption. As a result, deterioration of the pixels 110 may be reduced or minimized in a way that results in a reduction in power consumption.

In addition, according to one embodiment, gamma voltages VGMA are output so that brightness is reduced in the high grayscale region in accordance with the OPR of no less than the predetermined reference value (for example, an OPR of no less than 50) after dithering at least the gamma voltages VGMA in the high grayscale region. Therefore, it is possible to reduce or minimize grayscale banding. Therefore, the brightness may be reduced with a larger width for the OPR in at least a predetermined range, and thus it is possible to reduce or minimize power consumption. Therefore, even when a black screen is inserted between bright picture screens, so that the OPR rapidly changes like when pictures are looked over in a smart phone, a function of selectively limiting brightness may be applied only to the high grayscale region to thereby reduce or minimize flickering.

Figure 6:
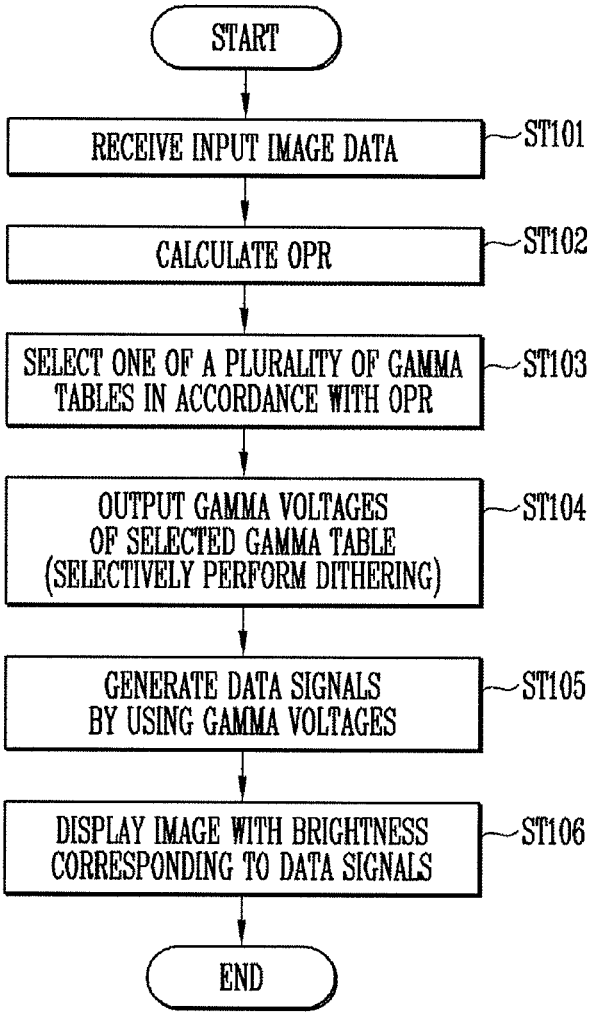
FIG. 6 illustrates an embodiment of a method for driving an organic light emitting display device.

FIG. 6 illustrates an embodiment of a method for driving an organic light emitting display device, which, for example, may correspond to any of the aforementioned embodiments of the display device.

First, when input image data RGB Data is supplied to the timing controller 400, the input image data RGB Data is input to the OPR operating unit 410 (ST101). The OPR operating unit 410 calculates the OPR in accordance with the input image data RGB Data (ST102). For example, the OPR operating unit 410 may calculate OPRs by colors by adding input data items of sub-pixels by colors and dividing the sum by the number of corresponding sub-pixels. In this case, for example, an OPR of red sub-pixels, an OPR of green sub-pixels, and an OPR of blue sub-pixels may be calculated. On the other hand, the OPR operating unit 410 may calculate an integrated OPR by averaging input data items of sub-pixels of all the colors without dividing the sub-pixels by colors.

The OPR calculated by the OPR operating unit 410 is input to the gamma voltage supplying unit 420.

The gamma voltage supplying unit 420 that receives the OPR selects one of the plurality of gamma tables, for example, the first to fifth gamma tables LUT1 to LUT5 in accordance with the OPR (ST103). For example, when the OPR of less than the predetermined reference value is input, the gamma voltage supplying unit 420 outputs the gamma voltages VGMA stored in the first gamma table LUT1 in accordance with the first gamma curve in which the reference gamma value is applied to the entire grayscale region.

In addition, when an OPR of no less than the predetermined reference value is input, the gamma voltage supplying unit 420 selects a gamma table (for example, one of the second to fifth gamma tables LUT2 to LUT5) in accordance with a gamma curve (for example, one of the second to fifth gamma curves) in which the reference gamma value is applied to the low grayscale region of less than the predetermined reference grayscale and the slope is gradually reduced in the high grayscale region of no less than the reference grayscale value when the OPR of no less than the predetermined reference value is input. The gamma voltages VGMA stored in the selected gamma table is then output.

On the other hand, when the OPRs by sub-pixels are input, the gamma voltage supplying unit 420 may select a gamma table based on one of the OPRs by sub-pixels. For example, the gamma voltage supplying unit 420 may select a gamma table based on a predetermined (e.g., the minimum) value among the OPRs by sub-pixels.

The gamma voltage supplying unit 420 that selects one of the gamma tables LUT1 to LUT5 outputs the gamma voltages VGMA stored in the selected gamma table (ST 104). At this time, the gamma voltage supplying unit 420 may selectively dither at least some gamma voltages VGMA and may output the dithered gamma voltages VGMA. For example, when one of the second to fifth gamma tables LUT2 to LUT5 to which the S-curved second to fifth gamma curves are applied is selected, the gamma voltage supplying unit 420 may dither the gamma voltages VGMA that belong to the high grayscale region of no less than the predetermined reference grayscale among the gamma voltages VGMA stored in the selected gamma table and may output the dithered gamma voltages VGMA.

In another embodiment, the gamma voltage supplying unit 420 may dither all the gamma voltages VGMA in the entire grayscale region and may output the dithered gamma voltages VGMA.

The gamma voltages VGMA output from the gamma voltage supplying unit 420 are input to the data driver 300 (ST105). The data driver 300 generates data signals corresponding to the input image data RGB Data by using the received gamma voltages VGMA and outputs the generated data signals to the data lines D1 to Dm.

The data signals output to the data lines D1 to Dm are input to the pixels 110 in the horizontal lines that are selected by the scan signals (ST106). Then, the pixels 110 emit light with brightness corresponding to the received data signals. Therefore, an image corresponding to the input image data RGB Data is displayed in the display region 100.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, units, and other processing features of the embodiments disclosed herein may be implemented in logic which, for example, may include hardware, software, or both. When implemented at least partially in hardware, the controllers, units, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the BMS may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, an amount of a driving current that flows through an entire pixel region of the organic light emitting display device may vary in accordance with input image data. As the amount of driving current increases, power consumption in accordance with current consumption increases and deterioration of the pixels is accelerated.

In accordance with one or more of the aforementioned embodiments, an OPR is calculated based on the input image data RGB Data, and gamma voltages VGMA for selectively reducing brightness of the pixels 110 in accordance with the calculated OPR are output. For example, the gamma voltages VGMA in which, based on the predetermined reference grayscale value, the reference gamma value is applied to the low grayscale region and the brightness is selectively reduced in accordance with the OPR only in the high grayscale region are output. The gamma voltages VGMA is applied in generating data signals. Therefore, it is possible to reduce or minimize deterioration of picture quality caused by flickering and to reduce current consumption. It is also possible to reduce or minimize deterioration of the pixels 110 and to effectively reduce power consumption.

In addition, according to at least one embodiment, in outputting the gamma voltages VGMA for reducing the brightness in comparison with the reference gamma value in the high grayscale region in accordance with an OPR of no less than the predetermined reference value, at least the gamma voltages in the high grayscale region are dithered and output so that grayscale banding may be reduced or minimized. Therefore, it is possible to increase or maximize the effect of reducing power consumption by limiting brightness with a larger width for an OPR in at least a predetermined range.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. An organic light emitting display device, comprising:

a timing controller to output gamma voltages corresponding to image data;

a data driver to generate data signals based on the gamma voltages; and a plurality of pixels to emit light with brightness corresponding to the data signals, wherein the timing controller includes:

an on-pixel ratio (OPR) operator to calculate an OPR based on the image data; and a gamma voltage supplier to select one of a plurality of gamma tables based on the OPR and to output gamma voltages stored in the selected one of the gamma tables.

2. The display device as claimed in claim 1, wherein the gamma tables include:

a first gamma table to store gamma voltages in accordance with a first gamma curve, in which a reference gamma value is applied to an entire grayscale region; and a second gamma table to store gamma voltages in accordance with a second gamma curve, in which a same gamma value as the first gamma curve is applied to a first grayscale region of less than a predetermined reference grayscale value and a slope is reduced in a second grayscale region of no less than the predetermined reference grayscale value.

3. The display device as claimed in claim 2, wherein the gamma voltage supplier is to output gamma voltages stored in the first gamma table when an OPR of less than a predetermined reference value is input from the OPR operator.

4. The display device as claimed in claim 2, wherein the gamma voltage supplier is to output gamma voltages stored in the second gamma table when an OPR of no less than a predetermined reference value is input from the OPR operator.

5. The display device as claimed in claim 4, wherein the gamma voltage supplier includes a ditherer to dither at least some of the gamma voltages.

6. The display device as claimed in claim 5, wherein the ditherer is to dither at least of the gamma voltages that belong to the second grayscale region among the gamma voltages stored in the second gamma table and is to output the dithered gamma voltages when an OPR of no less than the predetermined reference value is input from the OPR operator.

7. The display device as claimed in claim 2, wherein the gamma tables include a third gamma table in accordance with a third gamma curve, in which a same gamma value as the first and second gamma curves is applied to the first grayscale region, wherein a slope is reduced in the second grayscale region, and wherein a reduction width of brightness is to be set greater than in the second gamma curve.

8. The display device as claimed in claim 7, wherein the gamma voltage supplier is to determine at least three ranges to which the OPR input from the OPR operator belongs in accordance with a value of the OPR, select a gamma table in which a reduction width of brightness is greater in the second grayscale region as the OPR belongs to a larger range, and outputs gamma voltages stored in the selected gamma table.

9. A method for driving a display device, the display device including a calculator, a gamma voltage supplier, a data driver, and a plurality of pixels, the method comprising:

receiving image data;

calculating an on-pixel ratio (OPR) based on the image data by the calculator;

selecting one of a plurality of gamma tables based on the OPR by the gamma voltage supplier;

outputting gamma voltages stored in the selected gamma table by the gamma voltage supplier;

generating data signals based on the gamma voltages by the data driver; and displaying an image with brightness corresponding to the data signals by the plurality of pixels, wherein outputting gamma voltages includes outputting gamma voltages in accordance with a second gamma curve, in which a reference gamma value is applied to a first grayscale region of less than a predetermined reference grayscale value and a slope is reduced in a second grayscale region of no less than the reference grayscale, when an OPR of no less than a predetermined reference value is input.

10. The method as claimed in claim 9, wherein outputting gamma voltages includes outputting gamma voltages in accordance with a first gamma curve, in which a reference gamma value is applied to an entire grayscale region, when the OPR of less than a predetermined reference value is input.

11. The method as claimed in claim 9, further comprising dithering at least gamma voltages in the second grayscale region for output.

12. The method as claimed in claim 9, wherein at least three ranges to which the OPR belongs are determined.

13. The method as claimed in claim 12, wherein outputting gamma voltages includes:

outputting gamma voltages in which a reference gamma value is applied to an entire grayscale region when the OPR belongs to a first range, and outputting at least gamma voltages set to reduce brightness in comparison with the reference gamma value in a second grayscale region of no less than a predetermined reference grayscale when the OPR belongs to a second range different from the first range.

14. The method as claimed in claim 13, further comprising:

setting reduction widths of brightness of the gamma voltages differently in accordance with a range of the OPR when the OPR belongs to the second range.

15. The method as claimed in claim 9, wherein outputting the gamma voltages includes outputting gamma voltages, in which a reference gamma value is applied to a first grayscale region of less than a predetermined reference grayscale, regardless of the OPR.

16. An apparatus, comprising:

a calculator to calculate an OPR based on image data; and a selector to select one of a plurality of gamma tables based on the OPR and to output gamma voltages stored in the selected one of the gamma tables, the output gamma voltages corresponding to an image to be displayed on a display device, wherein the gamma tables include:

a first table to store gamma voltages corresponding to a first gamma curve in which a reference gamma value is applied to an entire grayscale region; and a second table to store gamma voltages corresponding to a second gamma curve in which a same gamma value as the first gamma curve is applied to a first grayscale region of less than a predetermined reference grayscale value and having a slope that is reduced in a second grayscale region of no less than the predetermined reference grayscale value.

* * * * *